US011441312B1

(12) United States Patent
Roberts

(10) Patent No.: US 11,441,312 B1
(45) Date of Patent: Sep. 13, 2022

(54) ARCHITECTURAL BUILDING BLOCK

(71) Applicant: Spherical Block LLC, Alfred Station, NY (US)

(72) Inventor: Peter Andrew Roberts, Alfred Station, NY (US)

(73) Assignee: Spherical Block LLC, Alfred Station, NY (US)

( * ) Notice: Subject to any disclaimer, the term of this patent is extended or adjusted under 35 U.S.C. 154(b) by 0 days.

(21) Appl. No.: 17/406,809

(22) Filed: Aug. 19, 2021

(51) Int. Cl.
*E04B 2/54* (2006.01)
*E04C 1/00* (2006.01)

(52) U.S. Cl.
CPC . *E04B 2/54* (2013.01); *E04C 1/00* (2013.01)

(58) Field of Classification Search
CPC ..... E04B 2/34; E04B 2/08; E04B 2/54; E04B 2/42; E04B 2/30; E04B 2002/0228
See application file for complete search history.

(56) References Cited

U.S. PATENT DOCUMENTS 2,141,397 A * 12/1938 Locke ..... E04B 2/42 52/564
3,780,484 A * 12/1973 Muse ..... E04B 2/14 52/568
8,061,095 B2 * 11/2011 Bucheger ..... E04B 2/44 52/607
D700,716 S * 3/2014 Harter ..... D25/113
9,133,619 B1 9/2015 Roberts et al.
D900,340 S * 10/2020 von Langsdorff ..... D25/113
10,883,267 B2 * 1/2021 Ravelli ..... E04C 1/40
2013/0276400 A1 * 10/2013 Genest ..... E04B 2/52 52/600
2016/0076246 A1 * 3/2016 Romanenko ..... E04C 1/397 52/601
2016/0090739 A1 * 3/2016 Johnson ..... E04C 3/34 52/561
2016/0123004 A1 * 5/2016 Lightfoot ..... E04B 2/08 52/286

* cited by examiner

*Primary Examiner* — Paola Agudelo
(74) *Attorney, Agent, or Firm* — Tracy Jong Law Firm; Tracy P. Jong; Cheng Ning Jong

(57) ABSTRACT

A rectangular block having a front surface, a rear surface, a bottom surface, a top surface defined by a pair of lengthwise edges and a pair of side edges connecting the lengthwise edges, the rectangular block including: a first channel disposed along a left side surface, the first channel extending in a direction from the front surface to the rear surface; and a second channel along a plane parallel to the left side surface, the plane disposed at an offset distance from the left side surface, the second channel extending in a direction from the front surface to the rear surface, wherein the left side surface is configured to be positionable so as to mate with a left side surface of an adjacently disposed block to form a full channel to receive a rebar, whereby walls are constructible from a plurality of such blocks.

13 Claims, 10 Drawing Sheets

ARCHITECTURAL BUILDING BLOCK

BACKGROUND OF THE INVENTION

1. The Field of the Invention

The present invention relates to an architectural building block capable to be combined with other blocks of its kind or another kind in more than one manner to form walls of various thicknesses. More specifically, the present invention is directed to an architectural building block capable to be combined with rebars and other blocks of its kind or another kind in more than one manner to form reinforced and walls of various thicknesses with interlocked wall blocks.

2. Background Art

Architectural building blocks of a type are traditionally constructed to allow the construction of a wall of a particular thickness only and with the arrangement of blocks in a particular manner only. Therefore, to construct walls of various thicknesses, more than one type of blocks or blocks of one type but of various sizes will be required. The need for blocks of various sizes and types to construct walls of different thicknesses or blocks that can accommodate various arrangements of rebars traditionally will require many types of blocks in one or more sizes. The use of various types of blocks and blocks of various sizes increases procurement costs as various molds are required and this limits the benefits realizable from the economy of scale due to the production of blocks based on a single mold. It is also possible that the availability of the various blocks may be limited as suppliers of various types of blocks or blocks of various sizes may need to stock substantially more blocks of various types and/or various sizes to anticipate demands.

There exists a need for blocks of a type useful for constructing walls of more than one thickness and blocks of a type useful for constructing reinforced walls of more than one thickness. U.S. Pat. No. 9,133,619 to Roberts et al. (hereinafter Roberts) discloses an architectural building block including a front terminal wall, a rear terminal wall disposed substantially parallel to the front terminal wall, a pair of side walls adjoining the front terminal wall and the rear terminal wall, a top wall and a bottom wall. The side walls lean toward one another. The pair of side walls converge from the rear terminal wall to the front terminal wall. The bottom wall is disposed substantially parallel to the top wall, wherein each of the top wall and bottom wall adjoins the front terminal wall, the rear terminal wall and the pair of side walls. Applicant discovered that the present architectural blocks lend themselves well to be arranged in various configurations to form walls of various thicknesses or walls with various arrangements of reinforcing elements. When combined with Roberts blocks, walls of various other thicknesses and reinforcing configurations can be formed.

SUMMARY OF THE INVENTION

In accordance with the present invention, there is provided a rectangular block having a front surface, a rear surface, a bottom surface, a top surface defined by a pair of lengthwise edges and a pair of side edges connecting the lengthwise edges, a length defined by one of the lengthwise edges, a depth defined by one of the side edges and a height defined by a perpendicular distance between the top surface and the bottom surface, the rectangular block including:

(a) a first channel disposed along a left side surface, the first channel extending in a direction from the front surface to the rear surface; and (b) a second channel along a plane parallel to the left side surface, the plane disposed at an offset distance from the left side surface, the second channel extending in a direction from the front surface to the rear surface, wherein the left side surface is configured to be positionable so as to mate with a left side surface of an adjacently disposed block to form a full channel to receive a rebar, whereby walls are constructible from a plurality of such blocks.

In one embodiment, the offset distance is about a third of the length of the rectangular block. In one embodiment, the first channel is a half channel and the second channel is a full channel. In one embodiment, the length of the rectangular block is about six inches. In one embodiment, the depth of the rectangular block is about four inches. In one embodiment, the depth of the rectangular block is about five inches. In one embodiment, the height of the rectangular block is about six inches. In one embodiment, the rectangular block is constructed from a material selected from the group consisting of concrete, cinders, vitrified ceramic, glass, plastic, wood pulp, cardboard, fiberglass, epoxy composite, metal, construction foam, tamped earth, boron, borides or any combinations thereof.

An object of the present invention is to provide building blocks of a single design or a limited number of designs where the building blocks are capable to be arranged in various manners to form walls of various thicknesses.

Another object of the present invention is to provide a building block that can accommodate one or more rebars.

Another object of the present invention is to provide a building block capable of assembly with similar building blocks with or without mortar.

Another object of the present invention is to provide building blocks that can be combined to form cavities that enable use of rebars in horizontal front-to-back orientations with respect to the thickness of the walls built with these blocks.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
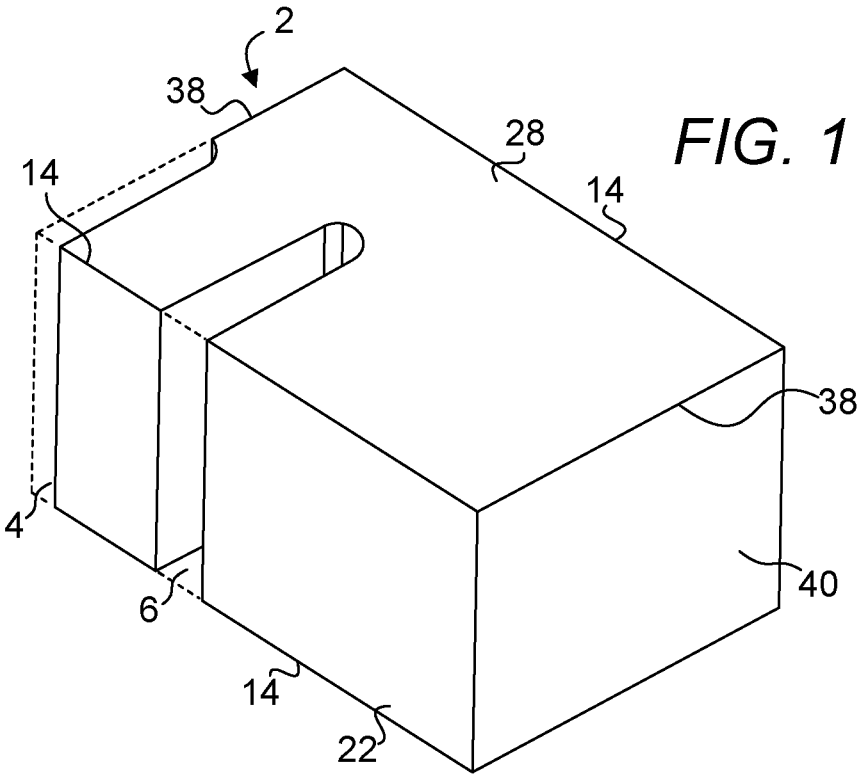
FIG. 1 is a top perspective view of a first embodiment of a present building block.

2— architectural building block
4— half channel
6— channel
8 — length of block
10 — depth of block or wall thickness or depth of block contributing to wall thickness
12 — height of block
14 — lengthwise edge
16 — architectural building block of Roberts
18 — base radius of channel
20 — base radius of half channel
22 — front surface
24 — distance between front surface and plane on which second channel is disposed
26 — rear surface
28 — top surface
30 — bottom surface
32 — distance between plane on which channel is disposed and right side surface
34 — opening width of channel
36 — opening width of half channel
38 — side edge
40 — side wall
42 — first course
44 — second course
46 — third course
48 — fourth course
50 — fifth course
52 — rebar
54 — direction
56 — height of Roberts block
58— channel
60 — front terminal wall
62 — rear terminal wall
64 — distance from the center of radius to rear surface
66 — span Particular Advantages of the Invention The present architectural building blocks are useful for construction of walls of various thicknesses by simply arranging groups of these blocks or groups of these and other blocks, e.g., blocks of Roberts, in certain ways to create arrangements that are staggered or un-staggered across courses.

The present architectural building blocks can be combined to form cavities that enable use of rebars in horizontal front-to-back orientations with respect to the thickness of the walls built with these blocks. The present architectural building blocks can also be combined with blocks of Roberts to form cavities that enable use of rebars in horizontal front-to-back orientations with respect to the thickness of the walls built with these blocks. Therefore, with these additional reinforcements from the front-to-back orientated rebars that are connected to vertically-oriented rebars, the strength of a resulting wall in a direction transverse to the length of the wall is increased.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

The surfaces of a present building block are referenced according to the manner in which the present building block is installed. A half and a full channel of the present building block extend from a front surface of the present building block with the half channel disposed to the left side of the full channel, on a left side surface. The wall thickness that results from an installation of such blocks are defined as the depth of the block. Vertically-disposed rebars are disposed through the channels in a top-bottom direction of the block. The height of the block is defined as a perpendicular distance between the top surface and the bottom surface of the present building block or the height of a course of a wall constructed from a plurality of the present building blocks.

FIG. 1 is a top perspective view of a first embodiment of a present building block 2.

Figure 2:
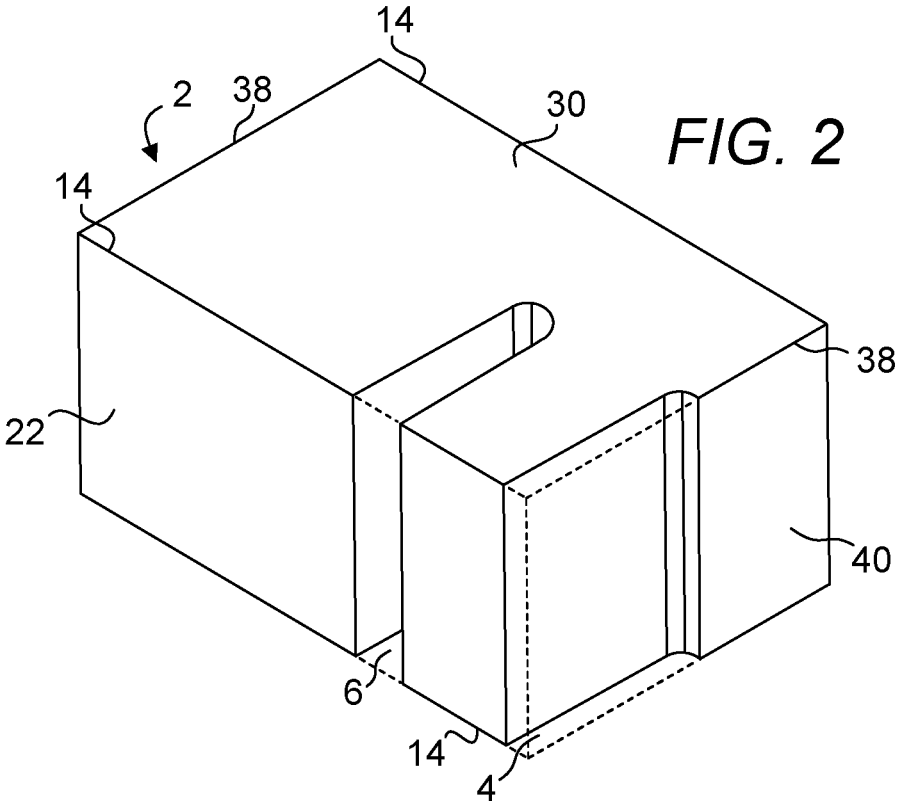
FIG. 2 is a bottom perspective view of a first embodiment of a present building block.

FIG. 2 is a bottom perspective view of a first embodiment of a present building block 2.

Figure 3:
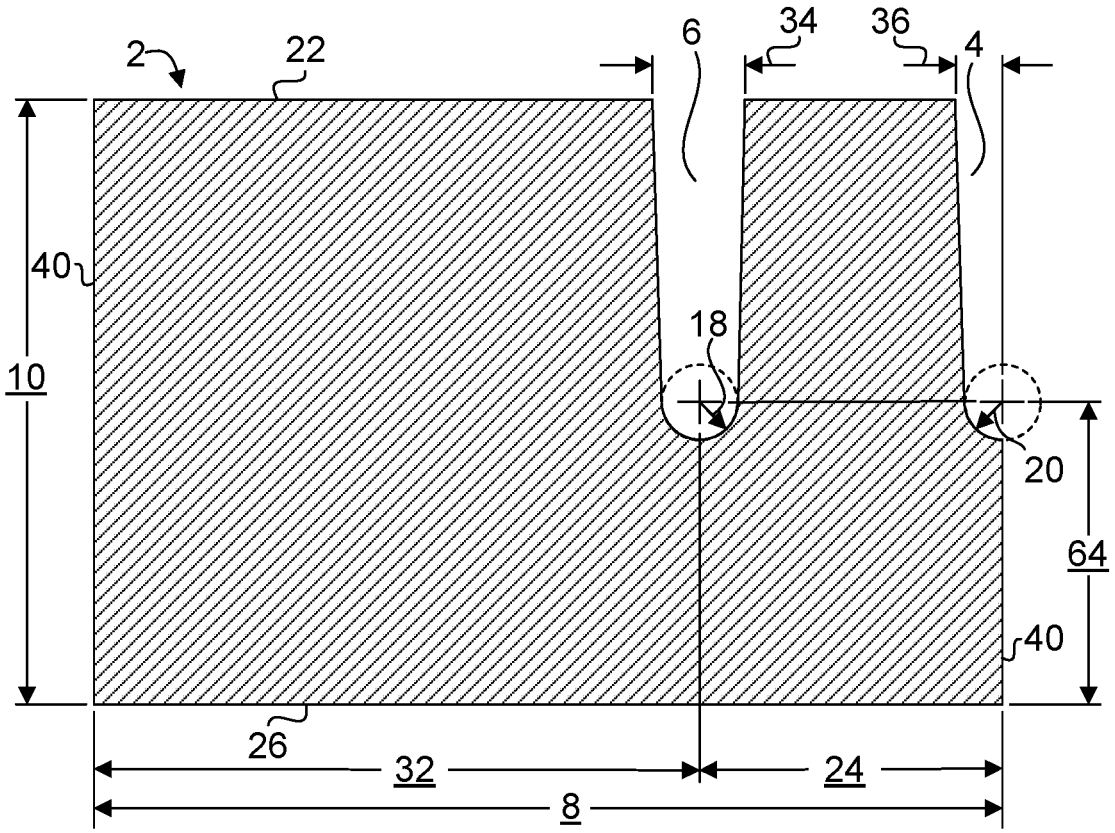
FIG. 3 is a plan view of a first embodiment of a present building block.
Figure 4:
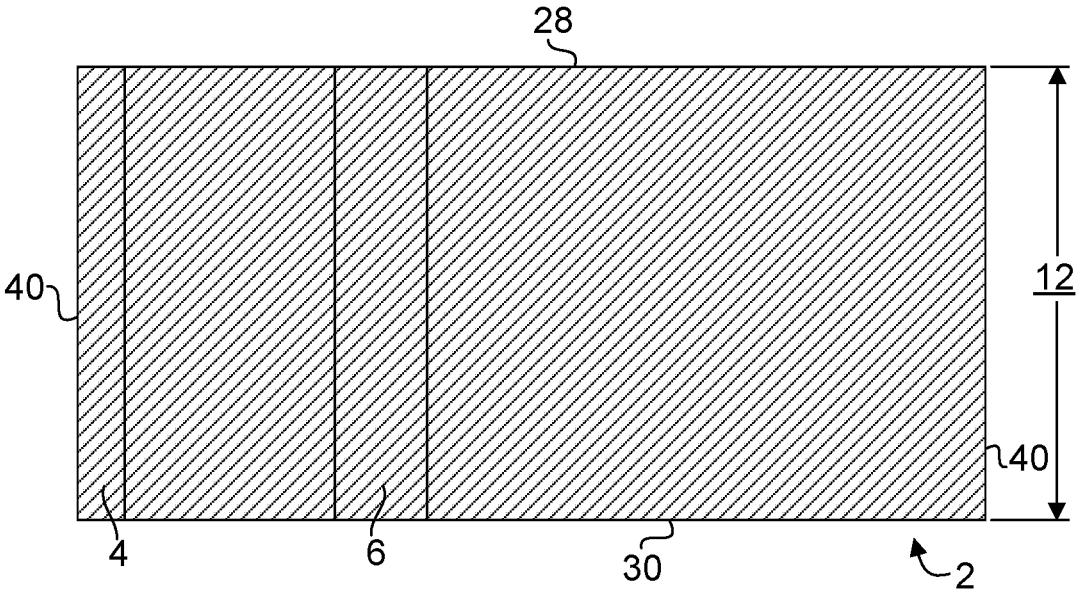
FIG. 4 is a front view of a first embodiment of a present building block.
Figure 5:
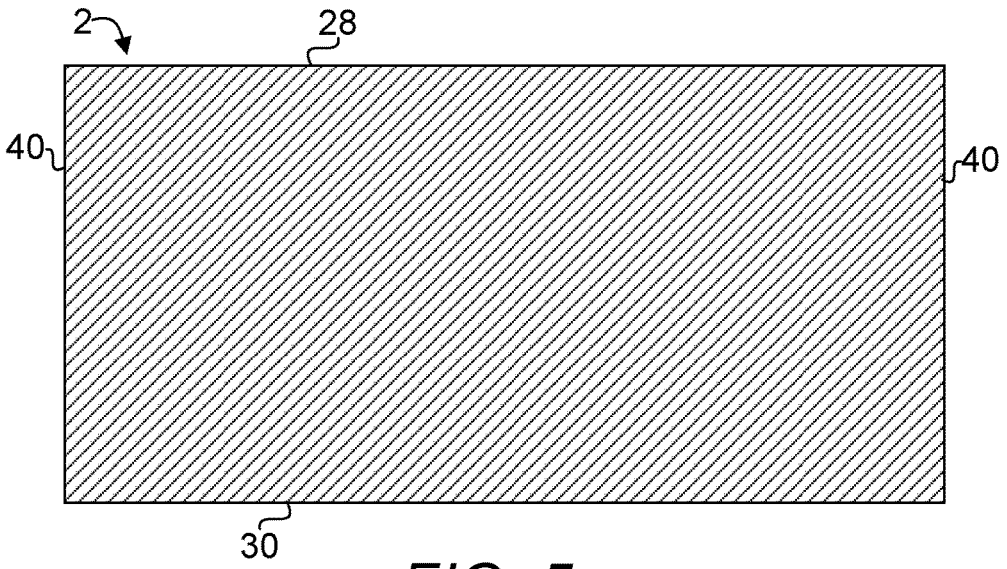
FIG. 5 is a rear view of a first embodiment of a present building block.
Figure 6:
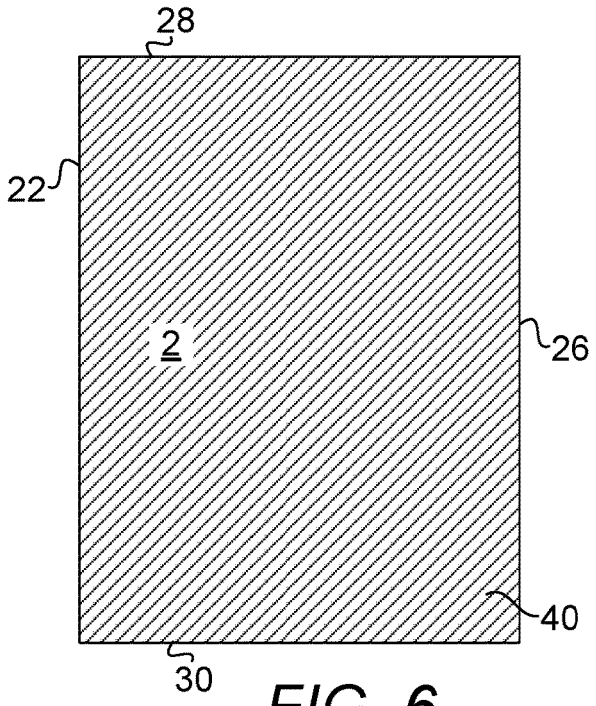
FIG. 6 is a right side view of a first embodiment of a present building block.
Figure 7:
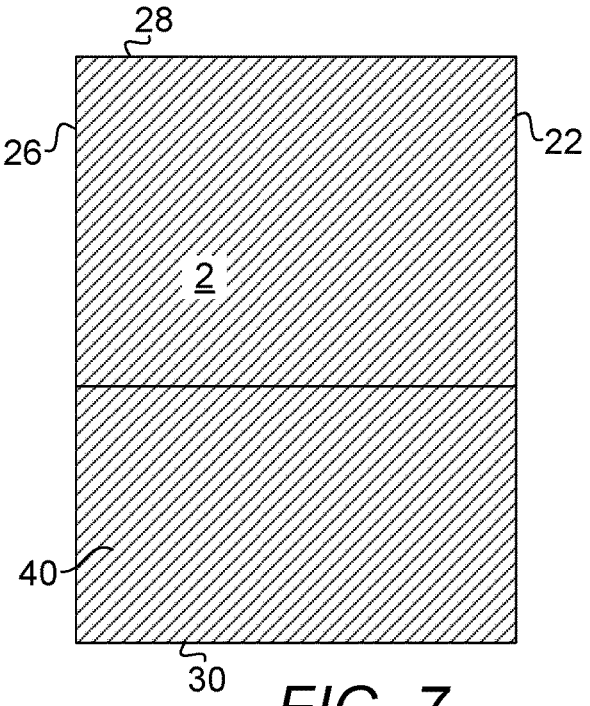
FIG. 7 is a left side view of a first embodiment of a present building block.

FIG. 3 is a top view of a first embodiment of a present building block 2. FIG. 4 is a front view of a first embodiment of a present building block 2. FIG. 5 is a rear view of a first embodiment of a present building block 2. FIG. 6 is a right side view of a first embodiment of a present building block 2. FIG. 7 is a left side view of a first embodiment of a present building block 2. The present building block 2 is essentially a rectangular block having a front surface 22, a bottom surface 30, a top surface 28 defined by a pair of lengthwise edges 14 and a pair of side edges 38 connecting the lengthwise edges 14, a length defined by one of the lengthwise edges 14, a depth defined by one of the side edges 38 and a height defined by a perpendicular distance between the top surface 28 and the bottom surface 30. The rectangular block includes a first channel 4 and a second channel 6. The first channel 4 is disposed along the front surface 22, the first channel 4 extending in a direction from the front surface 22 to the rear surface 26. The second channel 6 is disposed along a plane parallel to the side wall 40, the plane disposed at an offset distance 24 from the side wall 40. The second channel 6 extends in a direction from the front surface 22 to the rear surface 26. In one embodiment, the offset distance 24 is about a third of the length 8 of the rectangular block 2, leaving the distance 32 between the plane on which channel 6 is disposed and rear surface 26 to be about two thirds of the length of the rectangular block 2. In one embodiment, the first channel is a half channel and the second channel is a full channel. Therefore, in one embodiment, at a length 8 of about six inches, the offset distance 24 is about 2 inches. In one embodiment, the depth 10 of the rectangular block 2 is about four inches. In one embodiment, the height 12 of the rectangular block 2 is about six inches. The rectangular block may be constructed from concrete, cinders, vitrified ceramic, glass, plastic, wood pulp, cardboard, fiberglass, epoxy composite, metal, construction foam, tamped earth, boron, borides or any combinations of these materials thereof. In one embodiment, the opening width 34 of channel 6 is about ¾ inch. In one embodiment, the opening width 36 of half channel 4 is about ⅜ inch. The base of the full channel 6 may be represented with an arc having a radius 18. In one embodiment, the base radius 18 of channel 6 is about ½ inch. Again, the base of the half channel 4 may be represented with an arc having a radius 20. In one embodiment, the base radius 20 of half channel 4 is about ¼ inch. In one embodiment, the distance 64 from the center of radius 18, 20 to the rear surface 26 is about half the depth 10 of each block or about two inches.

Figure 8:
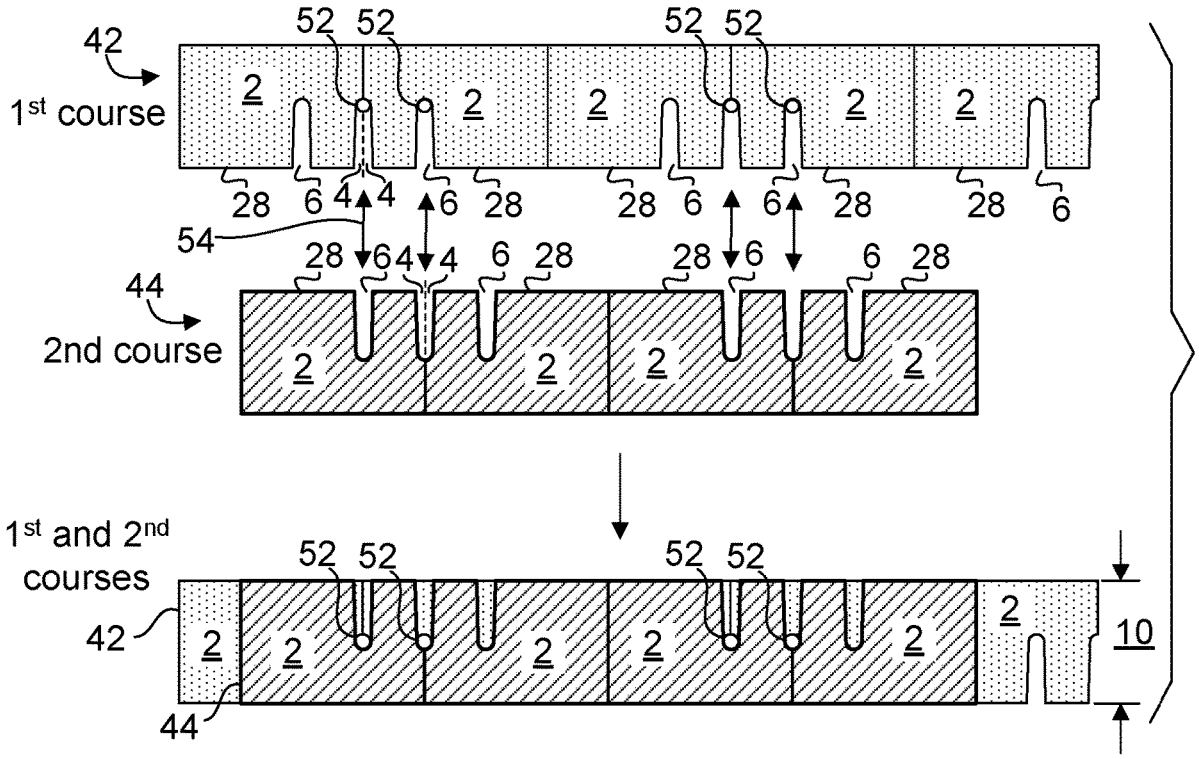
FIG. 8 is a plan view depicting the manner in which a four-inch wall is formed with a plurality of a first embodiment of the present building blocks.
Figure 8A:
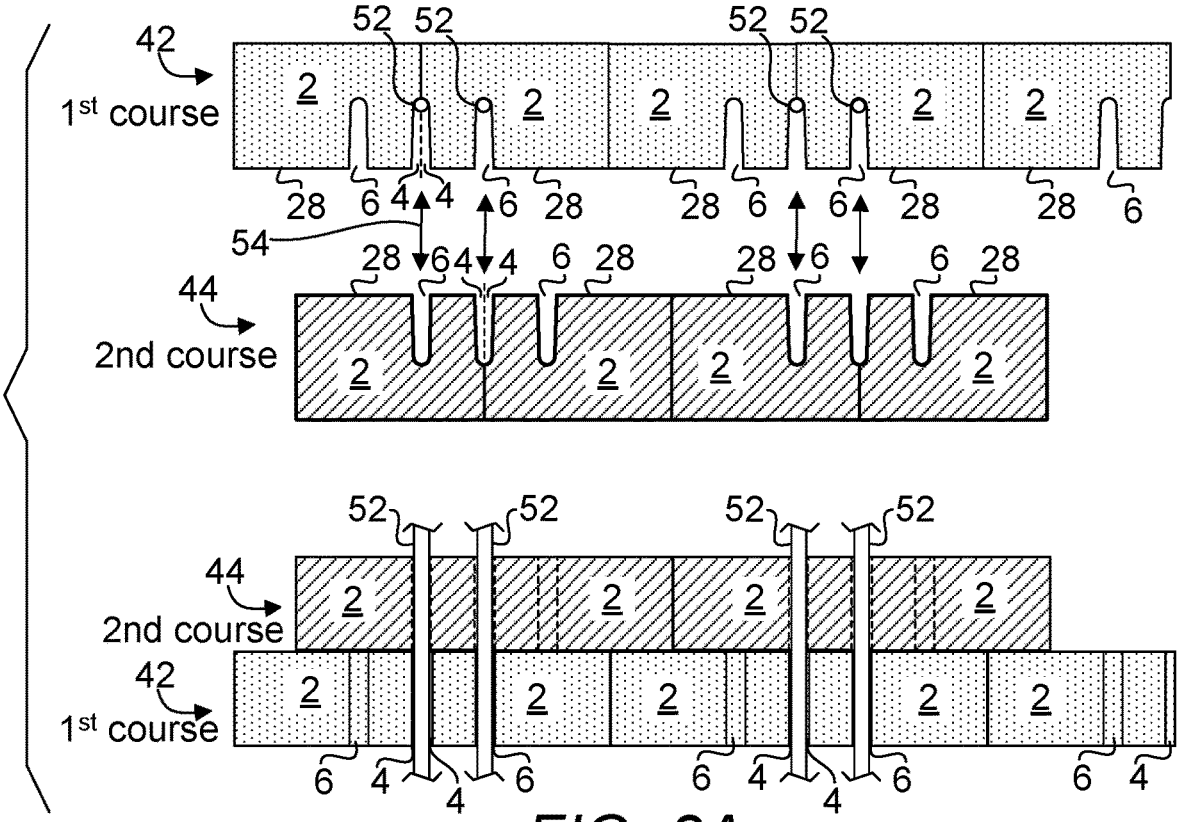
FIG. 8A shows a side view the four-inch wall of FIG. 8.

FIG. 8 is a plan view depicting the manner in which a four-inch wall is formed with a plurality of a first embodiment of the present building blocks 2. FIG. 8A shows a side view the four-inch wall of FIG. 8. It shall be noted that for each of the first course 42 and second course 44, the front surface 22 of a building block 2 is arranged to come in contact or mate with the front surface 22 of another building block 2 such that a full channel can be formed from the two half channels 4. A side wall 40 of a building block 2 is arranged to come in contact with a side wall 40 of another building block 2. In the embodiment shown, in forming a reinforced wall, the second course 44 is installed with the openings of the channels 4, 6 of the blocks 2 of the second course 44 in the opposite direction of the openings of the channels 4, 6 of the blocks 2 of the first course 42. A full channel formed from two half channels 4 of two blocks in a course is coupled with a full channel 6 of a block in a course above or below it. As the depth 10 of each block 2 is about four inches, the thickness of the wall formed reflects this depth 10. Note that each block 2 of either course can be installed in a direction 54 indicated or sideways as the channels 4, 6 can accommodate rebars 52 already installed, resulting in a course that interlocks with the course above or below it. It shall be noted that, no mortar is shown to have been applied in any of the figures disclosed herein. However, if mortar is desired to fill the channels 4, 6 and gaps between adjacent blocks, it may be applied according to conventional mortar application techniques. Suitable rebars may be constructed from Kevlar®, carbon fiber and the like.

Figure 9:
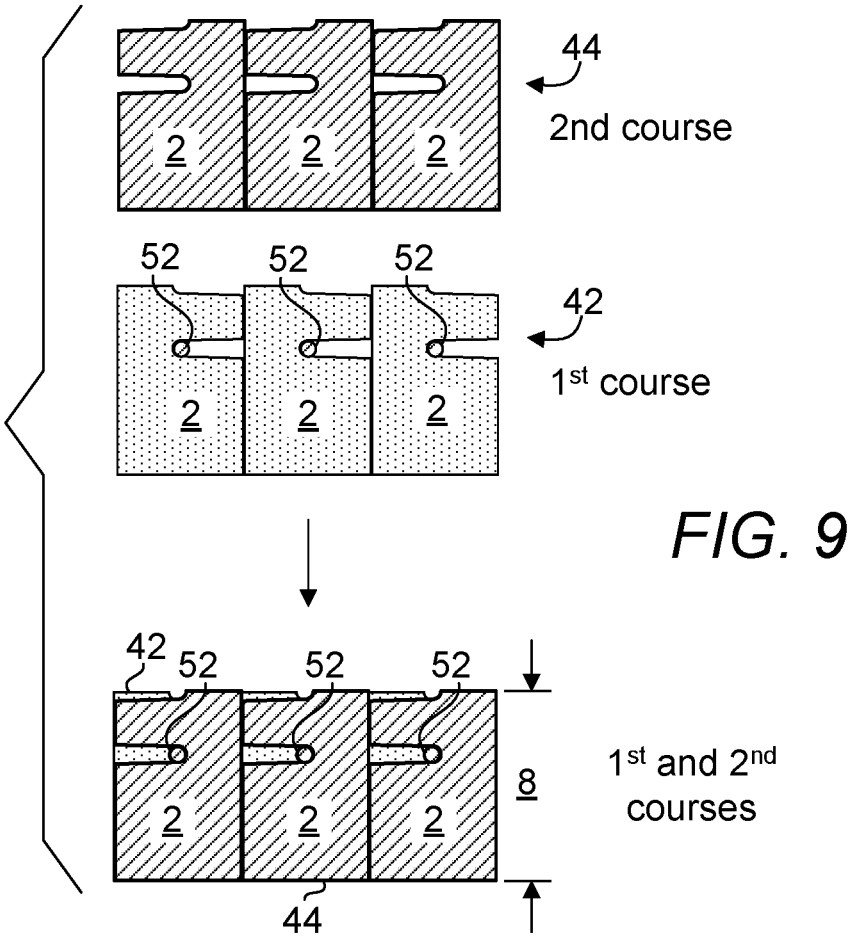
FIG. 9 is a plan view depicting the manner in which a six-inch wall is formed with a plurality of a first embodiment of the present building blocks.

FIG. 9 is a plan view depicting the manner in which a six-inch wall is formed with a plurality of a first embodiment of the present building blocks 2. It shall be noted that using the same blocks as shown in FIG. 8, a wall of a different thickness can result. As the length 8 of each block 2 is about six inches, the thickness of the wall formed reflects this length 8. Here, only the full channels 6 are used to engage with rebars 52 and the blocks 2 are arranged such that the front surface 22 of a block 2 comes in contact with the rear surface 26 of an adjacent block 2. Again, the corresponding block 2 of an adjacent course is disposed in a reverse fashion, i.e., with its channel openings disposed in a direction opposite to the channel openings of blocks 2 to result in a course that interlocks with the course above or below it. In each course, the blocks 2 are configured to be laid in a manner such that the full channels 6 are disposed in line with the wall being formed.

Figure 10:
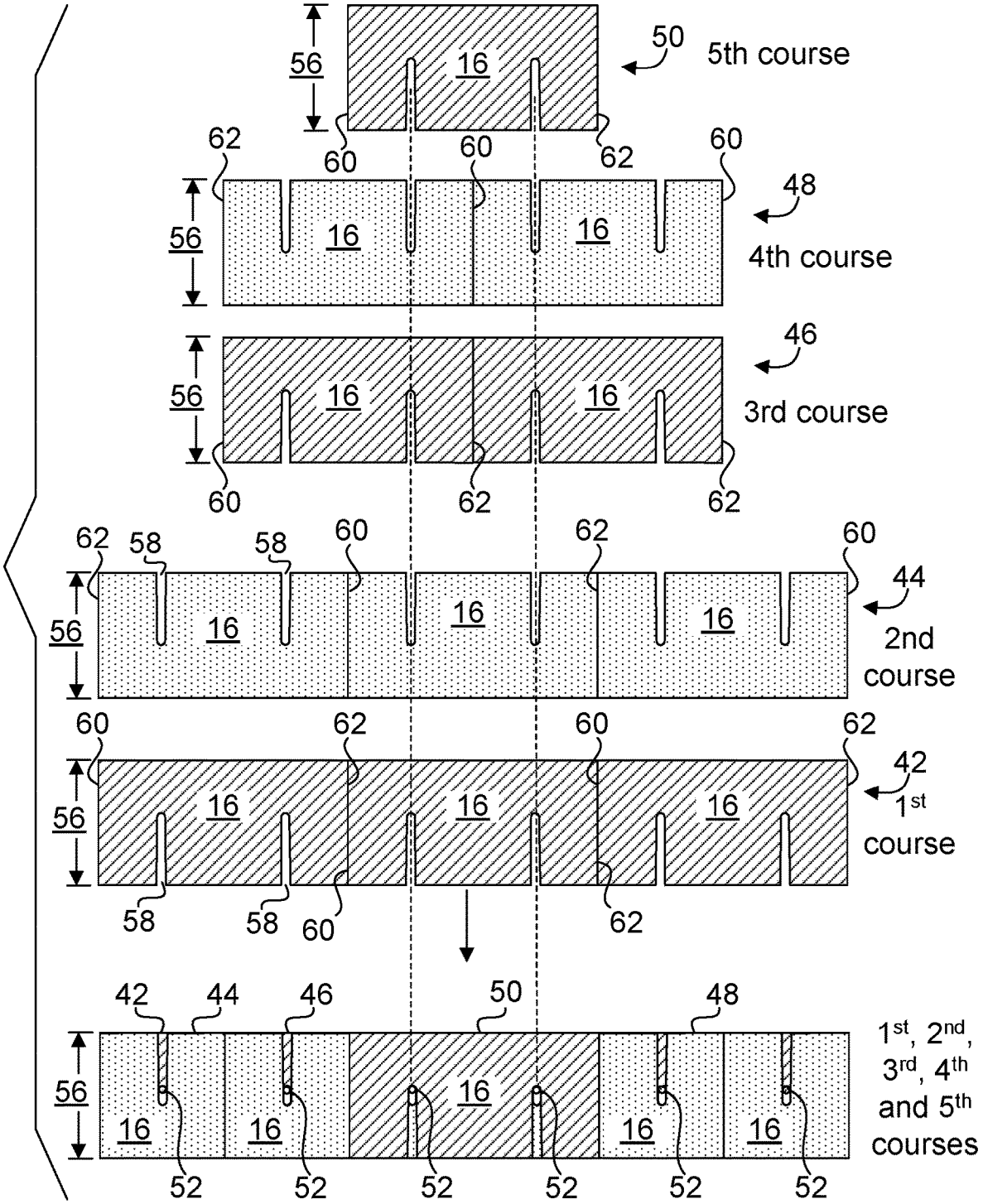
FIG. 10 is a plan view depicting the manner in which an eight-inch wall is formed with a plurality of the building blocks of Roberts.

FIG. 10 is a plan view depicting the manner in which an eight-inch wall is formed with a plurality of the building blocks 16 of Roberts. According to Roberts, the height 56 of block 16 is about eight inches. If walls of eight-inch thick are desired, Roberts blocks 16 may be used. Five courses 42, 44, 46, 48, 50 are shown with each course having Roberts blocks 16 disposed in the same orientation along the length of each course. It shall be noted that the blocks 16 of a course are disposed in an orientation opposite of those disposed in the course above or below it, resulting in the course that interlocks with the course above or below it. In two consecutive courses, the channels 58 of the blocks 16 are facing opposite directions. It shall also be noted that for Roberts blocks 16 to work to form rectangular walls, each pair of consecutive courses must be complementary to one another as each block is not a true rectangular block as the front terminal wall 60 has an area smaller that the rear terminal wall 62. For instance, in order to form a rectangular object having a top surface and a bottom surface that are parallel, a block 16 of the first course 42 orientated with the front terminal wall 60 on the left side must be coupled to a corresponding block 16 of the second course 44 orientated with the rear terminal wall 62 on the left side. As another example, in order to form a rectangular object having a top surface and a bottom surface that are parallel, a block 16 of the third course 46 orientated with the rear terminal wall 62 on the right side must be coupled to a corresponding block 16 of the fourth course 48 orientated with the front terminal wall 60 on the right side. Every two pairs of courses are preferably staggered. For instance, the front and rear terminal walls 60, 62 of the first course 42 and second course 44 are not disposed in alignment with the front and rear terminal walls 60, 62 of the third course 46 and fourth course 48 to interlock the blocks 16 along the lengthwise direction of the wall constructed from these blocks 16.

Figure 11:
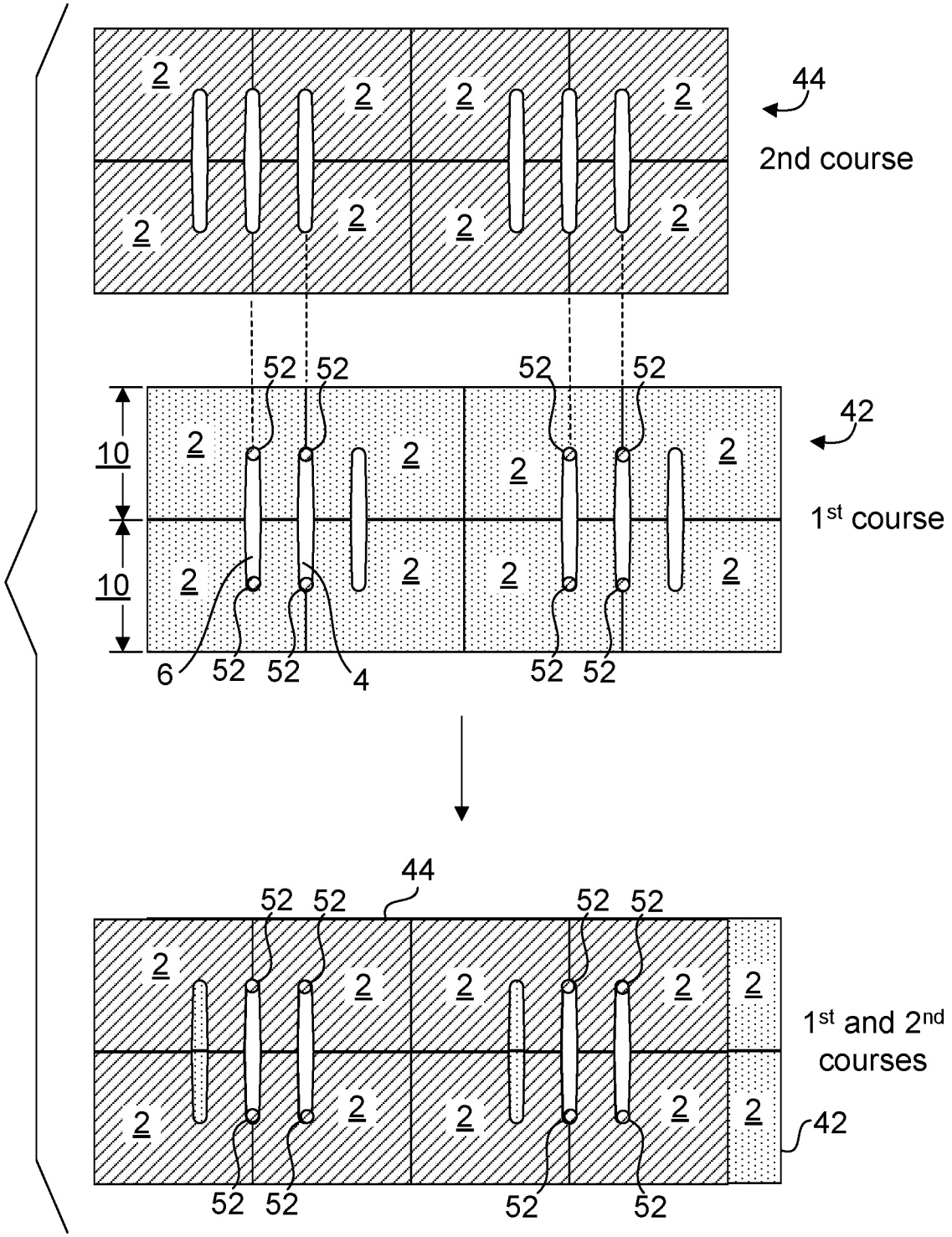
FIG. 11 is a plan view depicting the manner in which a ten-inch wall is formed with a plurality of a second embodiment of the present building blocks.

FIG. 11 is a plan view depicting the manner in which a ten-inch wall is formed with a plurality of a second embodiment of the present building blocks. In this embodiment, the depth 10 of the rectangular block 2 is about five inches. The width of each course or the thickness of the wall formed from these blocks is an aggregate of the depth 10 of two blocks 2, i.e., ten inches. Here, each repeating pattern is formed from four blocks with their half channels 4 facing and complementing half channels 4 of adjacent blocks 2. Four rebars 52 are used for each group of four blocks 2. Here, two consecutive courses are preferably staggered to increase cross-course interlocks of the blocks 2. It shall be noted that as vertically-disposed rebars 52 are disposed within the spaces encompassed by half and full channels 4, 6, it is possible to connect the vertically-disposed rebars 52 with horizontally-disposed rebars in these spaces, further reinforcing the resulting wall built from blocks 2. Therefore, the channels 4, 6 of the blocks and the arrangement of the blocks not only allow the staggering of the blocks 2 in adjacent courses for rebars disposed in a lengthwise direction of a resulting wall, they also enable reinforcement in a direction transverse to the lengthwise direction of a resulting wall.

Figure 12:
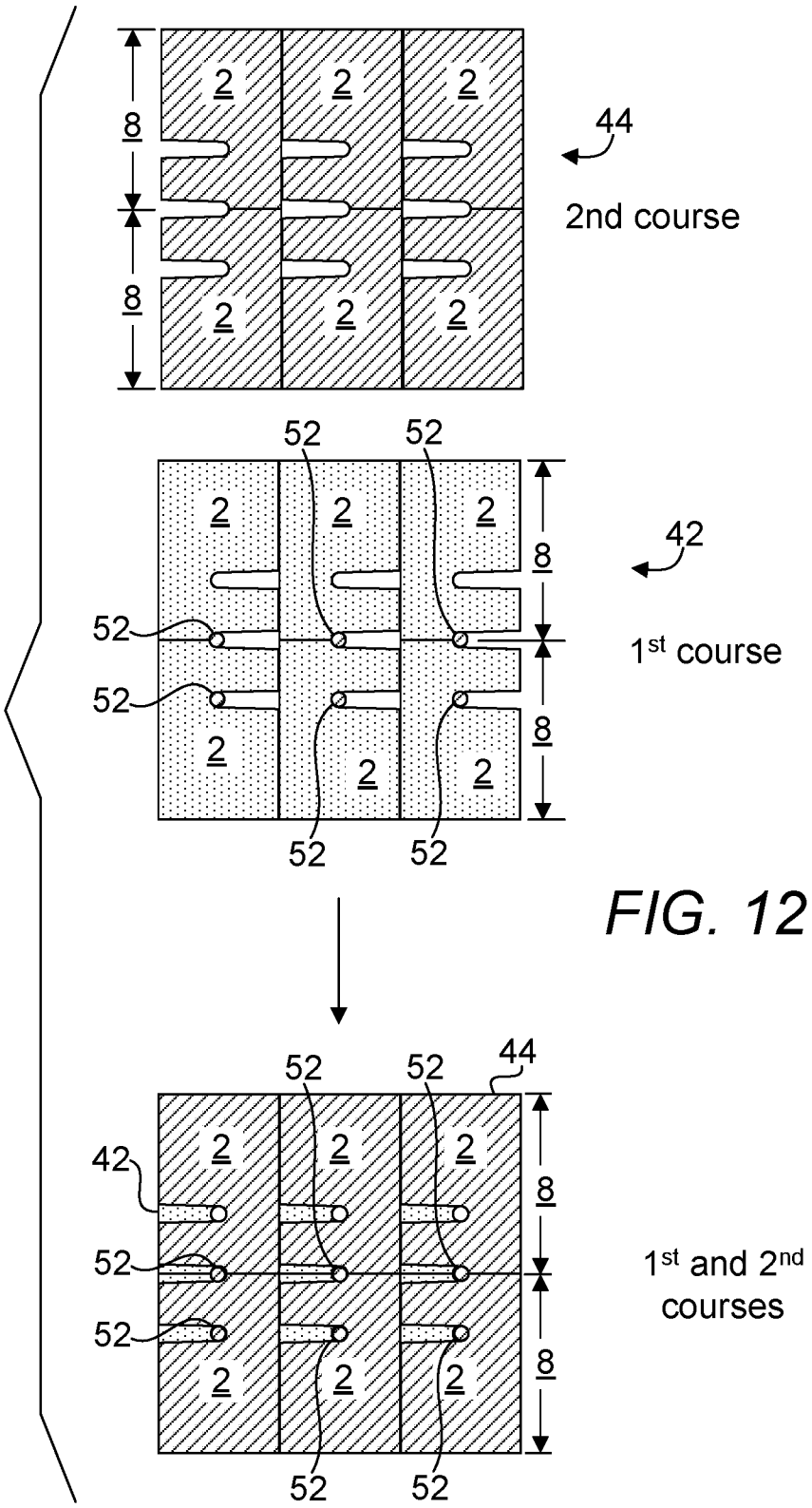
FIG. 12 is a plan view depicting the manner in which a twelve-inch wall is formed with a plurality of a first embodiment of the present building blocks.

FIG. 12 is a plan view depicting the manner in which a twelve-inch wall is formed with a plurality of a first embodiment of the present building blocks. The arrangement of blocks 2 is similar to the arrangement disclosed in FIG. 9 with the exception that one more block 2 is added to double the depth of each course. As the length 8 of each block is about six inches, the aggregate length of two blocks 2 is about twelve inches. As shown herein, two rebars 52 are used across the width of the wall formed by each pair of blocks 2.

Figure 13:
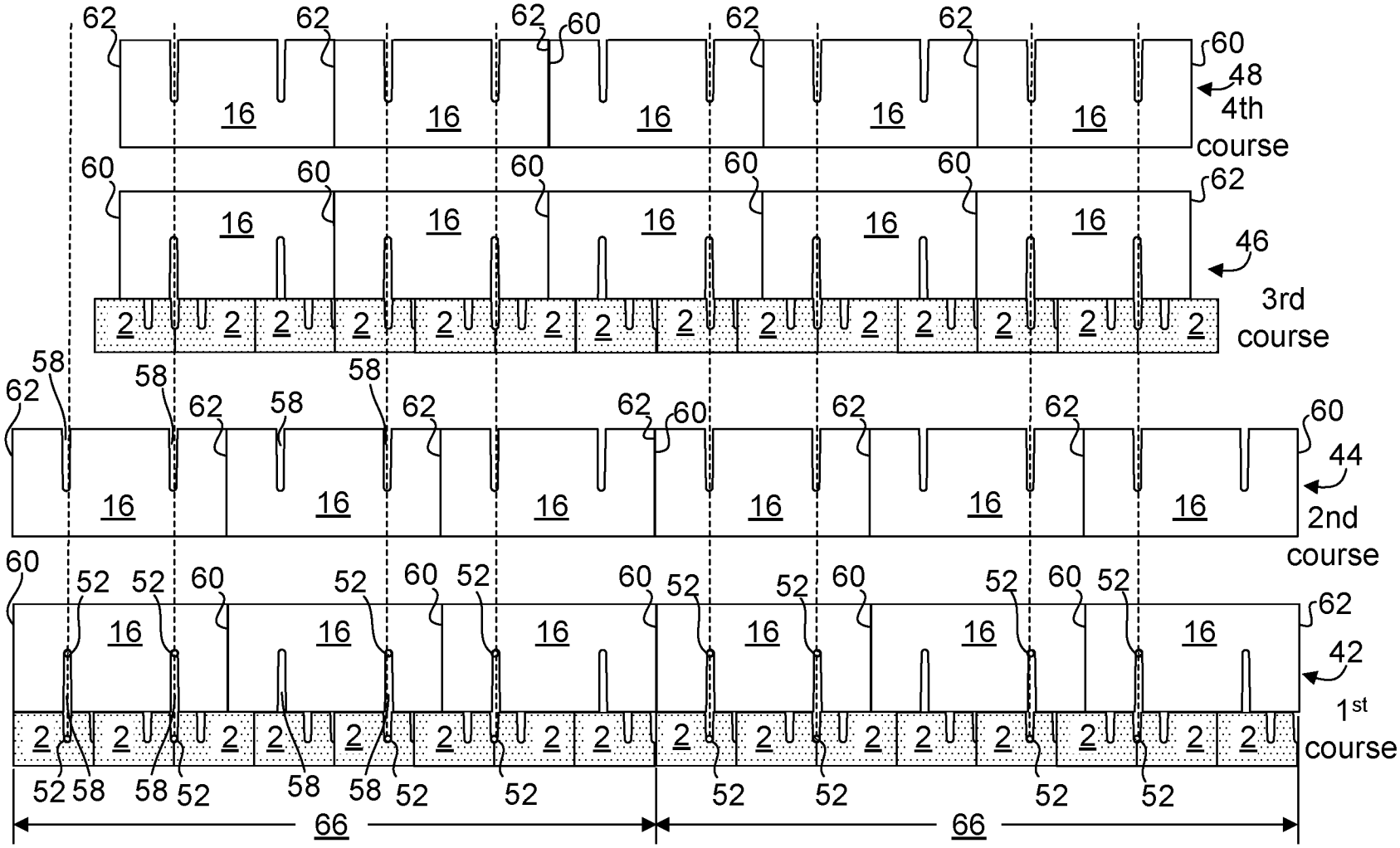
FIG. 13 is a plan view depicting the manner in which a twelve-inch wall is formed with a plurality of a first embodiment of the present building blocks and a plurality of the building blocks of Roberts.

FIG. 13 is a plan view depicting the manner in which a twelve-inch wall is formed with a plurality of a first embodiment of the present building blocks 2 and a plurality of the building Roberts blocks 16. Four courses, i.e., a first course 42, a second course 44, a third course 46 and a fourth course 48, are shown. For the first course 42, a combination of Roberts blocks 16 and the present building blocks 2 are used. Referring to both FIGS. 4 and 13, as the present block height 12 is about 6 inches or the combined height of two Roberts blocks 16, each of the present building block 2 spans two courses and therefore no present buildings blocks 2 are shown used in each of the second course 44 and fourth course 48. Roberts blocks 16 are disposed in the same orientation along the length of each course. It shall be noted that the blocks 16 of a course are disposed in an orientation opposite of those disposed in the course above or below it, resulting in the course that interlocks with the course above or below it. In two consecutive courses, the channels 58 of the blocks 16 are facing opposite directions. Again, it shall also be noted that for Roberts blocks 16 to work to form rectangular walls, each pair of consecutive courses must be complementary to one another as each block is not a true rectangular block as the front terminal wall 60 has an area smaller that the rear terminal wall 62. For instance, in order to form a rectangular object having a top surface and a bottom surface that are parallel, a block 16 of the first course 42 orientated with the front terminal wall 60 on the left side must be coupled to a corresponding block 16 of the second course 44 orientated with the rear terminal wall 62 on the left side. As another example, in order to form a rectangular object having a top surface and a bottom surface that are parallel, a block 16 of the third course 46 orientated with the rear terminal wall 62 on the right side must be coupled to a corresponding block 16 of the fourth course 48 orientated with the front terminal wall 60 on the right side. Every two pairs of courses are preferably staggered as the lengthwise edges of the blocks 16 in the first course 42 and second course 44 do not line up with the lengthwise edges of the blocks 16 in the third course 46 and the fourth course 48. For instance, the front and rear terminal walls 60, 62 of the first course 42 and second course 44 are not disposed in alignment with the front and rear terminal walls 60, 62 of the third course 46 and fourth course 48 to interlock the blocks 16 along the lengthwise direction of the wall constructed from these blocks 16. In this example, the lengthwise edges of the present blocks 2 that span the first course 42 and the second course 44 line up with the lengthwise edges of the present blocks 2 that span the third course 46 and the fourth course 48. Note the repeating pattern of the present blocks 2 in a span 66. In an arrangement not shown, to create the present blocks that are staggered in across courses, the pattern of the blocks 2 may be reversed. In other words, if the blocks 2 in the third course are arranged according to a mirror image of the blocks in each span 66, the blocks 2 in the third course can be made to form a staggered configuration with respect to the blocks 2 in the first course. It shall be noted that as vertical rebars 52 are disposed within the spaces encompassed by half and full channels 4, 6, it is possible to connect the vertically-disposed rebars 52 with horizontally-disposed rebars in these spaces, further reinforcing the resulting wall built from the combination of Roberts blocks 16 and blocks 2. Due to the interlocking nature of the blocks used in the construction of walls from the present blocks or the present blocks with blocks of Roberts, walls constructed using the arrangements shown herein can better withstand impact forces and/or seismic activities without resulting in a breach of the wall or a penetration of the wall, thereby protecting occupants or properties the wall is designed to protect. As the blocks used for constructing a wall are separate entities that may be joined together using a substrate, e.g., mortar, the severity of impact forces is lessened by the absorption of energy caused by the impact forces and cracks developed in the blocks as a result of the impact forces, can be terminated more effectively or restricted to only those blocks directly experiencing the impact forces, thereby maintaining the integrity of the wall and avoiding collapse or breach of the wall.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A rectangular block having a front surface, a rear surface, a bottom surface, a top surface defined by a pair of lengthwise edges and a pair of side edges connecting the lengthwise edges, a length defined by one of the lengthwise edges, a depth defined by one of the side edges and a height defined by a perpendicular distance between the top surface and the bottom surface, said rectangular block comprising:

(a) a first channel disposed along a left side surface, said first channel extending in a direction from the front surface to the rear surface; and (b) a second channel along a central plane of said second channel, said central plane is parallel to said left side surface, said plane disposed at an offset distance from said left side surface, said second channel extending in a direction from the front surface to the rear surface, wherein said offset distance is about a third of the length of said rectangular block and said left side surface is configured to be positionable so as to mate with a left side surface of an adjacently disposed block to form a full channel to receive a rebar, whereby walls are constructible from a plurality of such blocks.

2. The rectangular block of claim 1, said first channel is a half channel and said second channel is a full channel.

3. The rectangular block of claim 1, wherein the length of said rectangular block is about six inches.

4. The rectangular block of claim 1, wherein the depth of said rectangular block is about four inches.

5. The rectangular block of claim 1, wherein the depth of said rectangular block is about five inches.

6. The rectangular block of claim 1, wherein the height of said rectangular block is about six inches.

7. The rectangular block of claim 1, wherein said rectangular block is constructed from a material selected from the group consisting of concrete, cinders, vitrified ceramic, glass, plastic, wood pulp, cardboard, fiberglass, epoxy composite, metal, construction foam, tamped earth, boron, borides, and combinations thereof.

8. A rectangular block having a front surface, a rear surface, a bottom surface, a top surface defined by a pair of lengthwise edges and a pair of side edges connecting the lengthwise edges, a length defined by one of the lengthwise edges, a depth defined by one of the side edges and a height defined by a perpendicular distance between the top surface and the bottom surface, said rectangular block comprising:

(a) a half channel disposed along a left side surface, said half channel extending in a direction from the front surface to the rear surface; and (b) a first full channel along a central plane of said first full channel, said central plane is parallel to said left side surface, said plane disposed at an offset distance from said left side surface, said full channel extending in a direction from the front surface to the rear surface, wherein said offset distance is about a third of the length of said rectangular block and said left side surface is configured to be positionable so as to mate with a left side surface of an adjacently disposed block to form a second full channel to receive a rebar, whereby walls are constructible from a plurality of such blocks.

9. The rectangular block of claim 8, wherein the length of said rectangular block is about six inches.

10. The rectangular block of claim 8, wherein the depth of said rectangular block is about four inches.

11. The rectangular block of claim 8, wherein the depth of said rectangular block is about five inches.

12. The rectangular block of claim 8, wherein the height of said rectangular block is about six inches.

13. The rectangular block of claim 8, wherein said rectangular block is constructed from a material selected from the group consisting of concrete, cinders, vitrified ceramic, glass, plastic, wood pulp, cardboard, fiberglass, epoxy composite, metal, construction foam, tamped earth, boron, borides, and combinations thereof.

* * * * *